US007207271B2

(12) United States Patent
Hammond et al.

(10) Patent No.: US 7,207,271 B2
(45) Date of Patent: Apr. 24, 2007

(54) WEB PRINTING PRESS AND METHOD FOR CONTROLLING PRINT-TO-CUT AND/OR CIRCUMFERENTIAL REGISTER

(75) Inventors: Charles Reif Hammond, Durham, NH (US); Robert Michael Pimpis, Strafford, NH (US); John Sheridan Richards, Barrington, NH (US); Jackson Hacker Jones, Rochester, NH (US)

(73) Assignee: Goss International Americas, Inc., Dover, NH (US)

( * ) Notice: Subject to any disclaimer, the term of this patent is extended or adjusted under 35 U.S.C. 154(b) by 0 days.

(21) Appl. No.: 11/484,398

(22) Filed: Jul. 11, 2006

(65) Prior Publication Data

US 2006/0249044 A1 Nov. 9, 2006

Related U.S. Application Data

(62) Division of application No. 10/838,784, filed on May 4, 2004, now Pat. No. 7,096,789.

(51) Int. Cl.
*B41L 3/02* (2006.01)
*B41F 13/24* (2006.01)

(52) U.S. Cl. ..... 101/486; 101/248

(58) Field of Classification Search ..... 101/143, 101/144, 145, 180, 181, 182, 184, 185, 217, 101/218, 247, 248, 485, 486, 224, 226, 227
See application file for complete search history.

(56) References Cited

U.S. PATENT DOCUMENTS 5,142,981 A 9/1992 Dettinger et al. ..... 101/248
5,272,975 A * 12/1993 Dettinger et al. ..... 101/218
5,301,609 A 4/1994 Guaraldi et al. ..... 101/216
5,415,092 A 5/1995 Hern ..... 101/226
5,546,859 A 8/1996 Hern ..... 101/226
5,588,362 A * 12/1996 Sugiyama et al. ..... 101/218
5,826,505 A * 10/1998 Volz et al. ..... 101/183
6,092,466 A * 7/2000 Koch et al. ..... 101/485
6,227,111 B1 5/2001 Dawley et al. ..... 101/218
6,601,506 B2 8/2003 Dauer ..... 101/248

(Continued)

FOREIGN PATENT DOCUMENTS

GB 2149149 6/1985
JP 2003205598 A * 7/2003

*Primary Examiner*—Ren Yan
(74) *Attorney, Agent, or Firm*—Davidson, Davidson & Kappel, LLC

(57) ABSTRACT

A method for controlling a print-to-cut register in a shaftless web printing press having a first print unit having a first plate cylinder and first blanket cylinder for printing a web, at least one independent drive for the first print unit, and a folder having a cross cutter for cutting the web. The method includes printing the web using the first plate cylinder and first blanket cylinder so as to form at least one printed section of the web; sensing the print-to-cut register of the at least one printed section; and controlling the print-to-cut register of the first plate cylinder during printing via the first drive as a function of the sensing. The controlling includes pulling the first plate cylinder off impression and phasing the first plate cylinder with respect to the cross cutter using the independent drive. A method for controlling circumferential register and a printing press is also disclosed.

10 Claims, 1 Drawing Sheet

U.S. PATENT DOCUMENTS 6,615,726 B2 * 9/2003 Douillard et al. ..... 101/483
6,616,732 B1 * 9/2003 Grandmougin et al. ..... 95/96
6,644,184 B1 11/2003 Hajek et al. ..... 101/177
6,655,278 B2 * 12/2003 Kawabata ..... 101/248
6,837,159 B2 1/2005 Elkotbi et al. ..... 101/219
2003/0084765 A1 5/2003 Elkotbi et al.

* cited by examiner

WEB PRINTING PRESS AND METHOD FOR CONTROLLING PRINT-TO-CUT AND/OR CIRCUMFERENTIAL REGISTER

REFERENCE TO RELATED APPLICATIONS

This application is a divisional of U.S. patent application Ser. No. 10/838,784 filed May 4, 2004 now U.S. Pat. No. 7,096,789 and hereby incorporated by reference herein.

BACKGROUND OF THE INVENTION

The present invention relates generally to web printing presses and more particularly to a web printing press with register control and a method for controlling print-to-cut and/or circumferential registration of a web.

A web printing press, for example a newspaper printing press, will print a continuous web of material in one or more print units. In a folder of the printing press, the web will be folded, if desired, and then cut, so that papers or signatures result.

Great Britain Patent Application No. 2 149 149 describes a web-fed offset printing machines in which each print unit is separately driven. U.S. Pat. Nos. 6,601,506 and 6,644,184 purport to disclose web-fed offset printing machines in which each print unit is separately driven, and the cut and/or color register is controlled by presetting the rotary angle positions of the printing cylinders. U.S. Pat. Nos. 5,546,859 and 5,415,092 describe devices for presetting cut-off register in a folder of a web-fed printing press.

U.S. Patent Publication No. 2003/0084765 discloses a device for positioning a cross cut relative to printed images using phase angle adjustments between a print unit and a cross-cutter, and also using a path length variation device, for example a web compensator. This patent application is hereby incorporated by reference herein, as are U.S. Pat. Nos. 5,415,092, 5,546,859, 6,601,506 and 6,644,184.

BRIEF SUMMARY OF THE INVENTION

Presetting all of the drives of the print units in a shaftless printing press is complicated and time-consuming, as all drive motors for each print unit must be preset and the positions for each cylinder calculated and stored.

An object of the present invention is to permit quicker or-the-fly changes to circumferential print-to-print and/or print-to-cut registrations.

The present invention provides a method for controlling a print-to-cut register in a shaftless web printing press having a first print unit having a first plate cylinder and first blanket cylinder for printing a web, at least one independent drive for the first print unit, and a folder having a cross cutter for cutting the web, the method comprising the steps of:

- printing the web using the first plate cylinder and first blanket cylinder so as to form at least one printed section of the web;
- sensing the print-to-cut register of the at least one printed section; and
- controlling the print-to-cut register of the first plate cylinder during printing via the first drive as a function of the sensing, the controlling including pulling the first plate cylinder off impression and phasing the first plate cylinder with respect to the cross cutter using the independent drive.

"Plate cylinder" as defined herein may be any image cylinder including a directly imaged cylinder. "Off impression" for the plate cylinder means that the plate cylinder is not in printing contact with the web, and thus may include when the blanket cylinder does not contact the web and/or when the plate cylinder does not contact the blanket cylinder. A folder as defined herein may include a folder which creates single unfolded sheets.

By pulling the first plate cylinder off impression and phasing the first plate cylinder during printing, print-to-cut register deviations can be adjusted quickly without creating web tension problems.

The pulling of the plate cylinder off impression preferably occurs when the print-to-cut register deviation exceeds a predetermined amount. Below the predetermined amount, the plate cylinder may remain on impression, and the independent drive is phased with respect to the cross cutter. While phasing on impression takes place slowly so as not to create sufficient tension to break the web or to smear printing, if the register deviation is small enough phasing on impression will proceed quicker than with the plate cylinder off impression. The predetermined amount preferably is set so that the cycle time for phasing adjustment on impression is less than a time for phasing adjustment off impression. The predetermined amount can be a function of the type of web material used and known characteristics of the take-off mechanisms and drive.

The predetermined amount may be a length of the print-to-cut register deviation.

Additional plate cylinders printing the same web may also be controlled similarly to the first plate cylinder to adjust the print-to-cut register.

After the first plate cylinder is pulled off impression and phased, it is placed on impression again. The controlling of the print-to-cut register then may include a further phasing adjustment while the first plate cylinder contacts the web.

The present invention also provides a method for controlling circumferential register in a shaftless web printing press having a first print unit having a first drive and a first plate cylinder and first blanket cylinder printing a web and a second print unit having a second drive independently controllable from the first drive and a second plate cylinder and a second blanket cylinder printing the web on a same side as the first plate cylinder and first blanket cylinder, the method comprising the steps of:

- printing the web using the first plate cylinder and first blanket cylinder and printing the web using the second plate cylinder and second blanket cylinder so as to form at least one printed section of the web;
- sensing the circumferential register between the first plate cylinder and second plate cylinder via the at least one printed section; and
- controlling the circumferential register of the second plate cylinder during printing via the second drive as a function of the sensing, the controlling including pulling the second plate cylinder off impression and phasing the second plate cylinder with respect to the first plate cylinder using the second drive.

Larger phasing changes required for controlling of circumferential register can be performed via the phasing while off impression, while minor adjustment to circumferential register may be made while the print couple remains on impression.

In either the circumferential print-to-print or print-to-cut registration methods of the present invention, one of the print couples can first be preset so that a presetting of each cylinder printing the web thus is not necessary. Storing of the various cylinder positions of each cylinder can be eliminated. The first print unit for example can function as a master, and other print units printing the web may follow that master.

The printed section of the web may be a registration mark or part of an image.

The present invention also provides a shaftless web printing press including:

a first print unit having a first plate cylinder and first blanket cylinder for printing a web;

a drive motor for the first print unit independent of a further print unit printing the web;

a cross cutter downstream of the first print unit for cutting the web;

a sensor for reading a section of the web printed by the first print unit; and a controller receiving a first input from the sensor and for controlling the first drive motor, the controller controlling the first drive motor during printing to maintain a print-to-cut register by removing the first plate cylinder from printing contact with the web and phasing the first plate cylinder with respect to the cross cutter.

The present invention also provides a shaftless web printing press including:

a first print unit having a first plate cylinder and first blanket cylinder for printing a side of a web;

a second print unit having a second plate cylinder and second blanket cylinder printing the web on the other side;

a first drive motor for the first print unit; and a second drive motor for the second print unit independent of the first drive unit;

a sensor for reading a section of the side of the web printed by the first print unit and second print unit; and a controller receiving a first input from the sensor and for controlling the first drive motor and second drive motor, the controller controlling the second drive motor during printing to maintain a circumferential register by removing the second plate cylinder from printing contact with the web and phasing the second plate cylinder with respect to the first plate cylinder.

BRIEF DESCRIPTION OF THE DRAWINGS

The following FIGURES show a preferred embodiment of the present invention in which.

DETAILED DESCRIPTION

Figure 1:
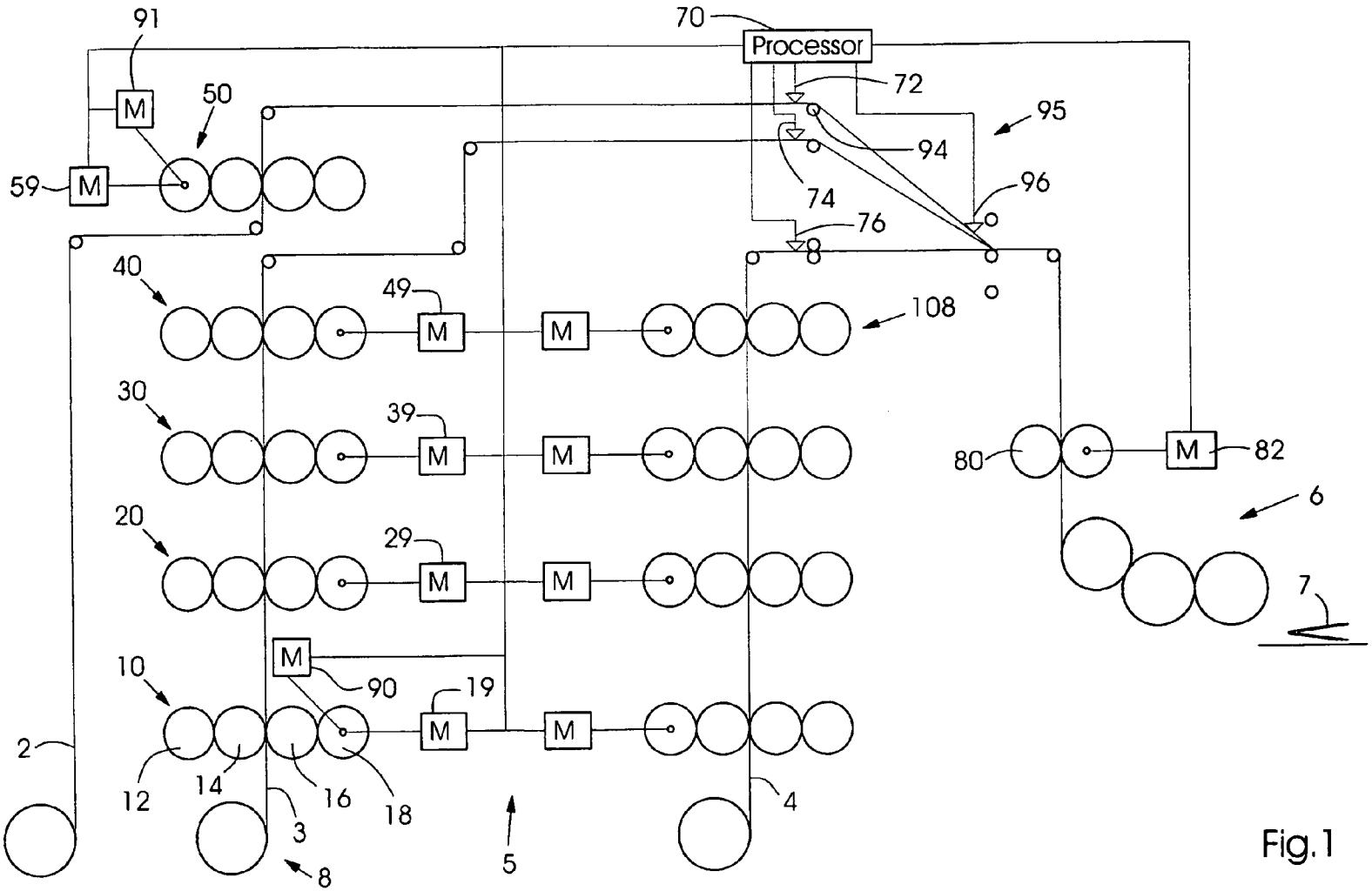
FIG. 1 shows an embodiment of an offset lithographic shaftless web printing press according to the present invention with both circumferential register and print-to-cut registration control.

FIG. 1 shows a multicolor offset lithographic shaftless printing press 5 according to the present invention, in which webs 2, 3 and 4 are printed and cut in a folder 6 into signatures or papers 7, such as newspapers.

A first print unit tower 8 has print units 10, 20, 30, 40 each of which include, in this embodiment, a plate cylinder 12, blanket cylinder 14, blanket cylinder 16, and plate cylinder 18. The cylinders 12, 14, 16, 18 of each print unit 10, 20, 30, 40 are driven independently by motors 19, 29, 39, 49, respectively. A controller 70 controls the motors and can receive inputs from sensors 72, 74, 76 which can read marks or image locations on webs 2, 3 and 4. Each print unit 10, 20, 30, 40 may, for example, print a different color, for example, cyan, magenta, yellow and black to create four-color images.

Tower 8 may also have an imprinter unit or other offset print unit 50, driven by a motor 59 also controlled by controller 70.

While various web configurations are possible, FIG. 1 shows web being printed by print unit 50, for example being printed in black, and web 3 being printed by print units 10, 20, 30, 40, for example in four-color.

Web 4 may be printed in a second tower 108, for example having four print units, each with an individually controllable drive motor.

More than one drive motor can also be provided for each print unit, for example each print couple, i.e. a plate cylinder/blanket cylinder pair, may have a drive motor.

Folder 6 includes a cross cutter 80 for cutting the webs 3, 4, 5 into signatures or papers 7, and a motor 82 may drive the cross cutter 80. Each motor also may provide a phase or angle position to the controller 70, indicating the position or angle of a cylinder with respect to a reference position. Thus motor 82 can provide a signal indicating that the knife of the cross cutter 80 is at certain number of degrees from the nip of the cross cutter 80, and motor 19 can provide a signal indicative of the position of print couple 16/18 with respect to the nip of the print unit 10.

Each print unit also has a throw-off mechanism or motor 90 to throw the plate cylinder 18 and/or the blanket cylinder 16 off impression, for example as described in U.S. Pat. Nos. 5,301,609 and 6,227,111, which are hereby incorporated by reference herein.

The controller 70 thus can drive the motors 19, 29, 39, 49 to set proper circumferential registration, i.e. here color registration, using the input from the sensor 74. For example, the drive motor 49 may be used as a master, and the other motors 19, 29, 39 can follow this master. Thus, if print unit 10 is printing Cyan and print unit 40 Black, and the sensor 74 determines that Cyan is being printed out of register with respect to Black, processor 70 determines the phase change for motor 19 needed to adjust the registration. If the phase change needed exceeds a certain amount, which may be predetermined or estimated, the processor 70 pulls plate cylinder 18 off impression via throw-off mechanism 90 (which may include or mean pulling blanket cylinder 16 off impression) while the web 3 continues moving through the print unit 10. The plate cylinder 18 is then phased as needed to with respect to the plate cylinder on the same side of web 3 in print unit 40 while off impression, and returned to impression.

For a needed phase change to adjust a register deviation that is below the certain amount, the motor 19 can be phased with respect to motor 49 while the plate cylinder remains on impression.

Since phase changes while printing typically must occur slowly to prevent a web break, but can occur quickly when the plate cylinder is off impression, the present invention can significantly decrease the time needed to adjust registration deviation.

The certain amount discussed above can be predetermined and can be set by an operator, for example based on experience. The predetermined amount preferably is a function of the characteristics of (1) the throw-off mechanism, for example how long it takes to throw on and off the plate cylinder, (2) of the drive motors and controller printing press, for example how quickly the drive motors can be phased while the web is still being printed versus when the plate cylinder is off impression, and (3) of the web itself, for example how sensitive the web is to web breaks when the drive motors are being phased while the web is being printed.

In addition to the circumferential print-to-print registration control, the controller also provides a print-to-cut registration adjustment. For example, if the sensor 72 determines that the print-to-cut registration of the images on web 2 is improper, the processor can determine a phase adjustment for the motor 59 with respect to the motor 82 for cross cutter 80. If the phase change needed exceeds a certain amount, which may be predetermined or estimated, the processor 70 pulls plate cylinder off impression via throw-off mechanism 91 while the web 2 continues moving through the print unit 50. The plate cylinder is then phased as needed to with respect to the cross cutter 80 while off impression, and returned to impression. If the phase change is below the certain amount, the drive motor 59 is phased while the web 2 is printed.

Sensor 74 can also provide print-to-cut registration feedback control for web 3, in which all plate cylinders printing web 3 can be pulled off impression if large phase adjustments are needed and to preserve color registration.

The feedback control provided by processor 70 and sensors 72, 74, 76 can be continuous.

The sensors 72, 74, 76 can be located prior to angle bars 94. Webs 2, 3, 4 may be slit into ribbons and recombined in a ribbon section 95 before entering the cross-cutter 80. The web and ribbon travel from the angle bars to the cross cutter 80 may be known from the type of print job being performed, for example, and thus the print-to-cut registration information provided by sensors 72, 74, 76 is sufficient. However, it may be advantageous to provide a plurality of sensors 96 closer to the cross-cutter 80, for example one for each ribbon, to improve the print-to-cut registration capabilities.

What is claimed is:

1. A method for controlling circumferential register in a shaftless web printing press having a first print unit having a first drive and a first plate cylinder and first blanket cylinder printing a web and a second print unit having a second drive independently controllable from the first drive and a second plate cylinder and a second blanket cylinder printing the web on a same side as the first plate cylinder and first blanket cylinder, the method comprising the steps of:

printing the web using the first plate cylinder and first blanket cylinder and printing the web using the second plate cylinder and second blanket cylinder so as to form at least one printed section of the web;

sensing the circumferential register between the first plate cylinder and second plate cylinder via the at least one printed section; and controlling the circumferential register of the second plate cylinder during printing via the second drive as a function of the sensing, the controlling including pulling the second plate cylinder off impression and phasing the second plate cylinder with respect to the first plate cylinder using the second drive.

2. The method as recited in claim 1 wherein the pulling of the second plate cylinder off impression occurs when the circumferential print-to-print register has a deviation exceeding a certain amount.

3. The method as recited in claim 2 wherein below the certain amount, the second plate cylinder remains in printing contact with the web and the second drive is phased with respect to the first drive.

4. The method as recited in claim 2 wherein the certain amount is set so that a time for a phasing adjustment with impression take-off is less than a time for a phasing adjustment without impression takeoff.

5. The method as recited in claim 2 wherein the certain amount is predetermined as a function of known characteristics of the take-off mechanisms and the independent drive.

6. The method as recited in claim 2 wherein the phasing adjusts the deviation.

7. The method as recited in claim 1 further comprising controlling additional plate cylinders printing the same web so as to adjust the circumferential register.

8. The method as recited in claim 1 further comprising setting a position of the first plate cylinder prior to printing.

9. The method as recited in claim 1 wherein the printed section is a registration mark.

10. A shaftless web printing press including:

a first print unit having a first plate cylinder and first blanket cylinder for printing a side of a web;

a second print unit having a second plate cylinder and second blanket cylinder printing the web on the side;

a first drive motor for the first print unit; and a second drive motor for the second print unit independent of the first drive unit;

a sensor for reading a section of the side of the web printed by the first print unit and second print unit; and a controller receiving a first input from the sensor and for controlling the first drive motor and second drive motor, the controller controlling the second drive motor during printing to maintain a circumferential register by removing the second plate cylinder from printing contact with the web and phasing the second plate cylinder with respect to the first plate cylinder.

* * * * *